US006237960B1

(12) United States Patent
Dornhofer

(10) Patent No.: US 6,237,960 B1
(45) Date of Patent: May 29, 2001

(54) ROLLER-TYPE SKIING DEVICE FOR NEGOTIATING A SLOPE

(76) Inventor: Siegfried Dornhofer, Innerer Kühstand 26, 3124 Oberwölbing (AT)

( * ) Notice: Subject to any disclaimer, the term of this patent is extended or adjusted under 35 U.S.C. 154(b) by 0 days.

(21) Appl. No.: 08/395,411

(22) Filed: Feb. 27, 1995

(30) Foreign Application Priority Data

Mar. 1, 1994 (AT) ..... 424/94

(51) Int. Cl.[7] ..... A63C 17/00
(52) U.S. Cl. ..... 280/842; 280/87.041; 301/5.3
(58) Field of Search ..... 280/842, 11.19, 280/11.27, 11.22, 87.041, 87.042; 301/5.3, 5.7

(56) References Cited

U.S. PATENT DOCUMENTS

| | | | | |
|---|---|---|---|---|
| 339,382 | * | 4/1886 | Colburn | 301/5.3 |
| 954,993 | * | 4/1910 | Peters | 280/11.19 |
| 2,878,071 | * | 3/1959 | Fowlkes | 301/5.3 |
| 3,355,185 | * | 11/1967 | Carter | 301/5.7 |
| 3,522,951 | * | 8/1970 | Tyson | 280/842 |
| 3,622,172 | * | 11/1971 | Goodwin | 280/11.22 |
| 3,827,706 | * | 8/1974 | Milliman | 280/842 |
| 4,045,046 | * | 8/1977 | Taylor et al. | 301/5.7 |
| 4,805,934 | * | 2/1989 | Mullenax | 280/87.042 |
| 4,921,513 | * | 5/1990 | Parten | 280/11.19 |
| 5,096,225 | * | 3/1992 | Osawa | 280/11.28 |
| 5,114,166 | * | 5/1992 | McCosker | 301/5.7 |
| 5,183,276 | * | 2/1993 | Pratt | 280/11.22 |
| 5,192,088 | * | 3/1993 | Yu | 280/11.22 |
| 5,224,718 | * | 7/1993 | Gertler | 280/11.22 |
| 5,356,209 | * | 10/1994 | Hill | 301/5.7 |
| 5,388,350 | * | 2/1995 | Parker, Jr. | 280/11.19 |
| 5,411,320 | * | 5/1995 | Alderman et al. | 301/5.3 |
| 5,527,100 | * | 6/1996 | O'Donnell et al. | 301/5.3 |

FOREIGN PATENT DOCUMENTS

| | | | | |
|---|---|---|---|---|
| 20606 | * | 6/1910 | (GB) | 301/5.3 |
| 564304 | * | 6/1957 | (IT) | 280/79.11 |

* cited by examiner

*Primary Examiner*—J. J. Swann
*Assistant Examiner*—David R. Dunn
(74) *Attorney, Agent, or Firm*—Henry M. Feiereisen

(57) ABSTRACT

A roller-type skiing device, in particular a roller ski or a roller skiboard, includes a chassis defining a longitudinal axis and having an underside bounded by an envelope. Supported by the chassis is at least one row with a plurality of wheels which are evenly distributed over the entire underside and are rotatably mounted on axles arranged in parallel relationship to each other. The wheels are of varying length to conform to the contour of the envelope, with neighboring wheels defining a free intermediate space which is not significantly greater than an area covered by the wheels.

15 Claims, 8 Drawing Sheets

FIG. 1
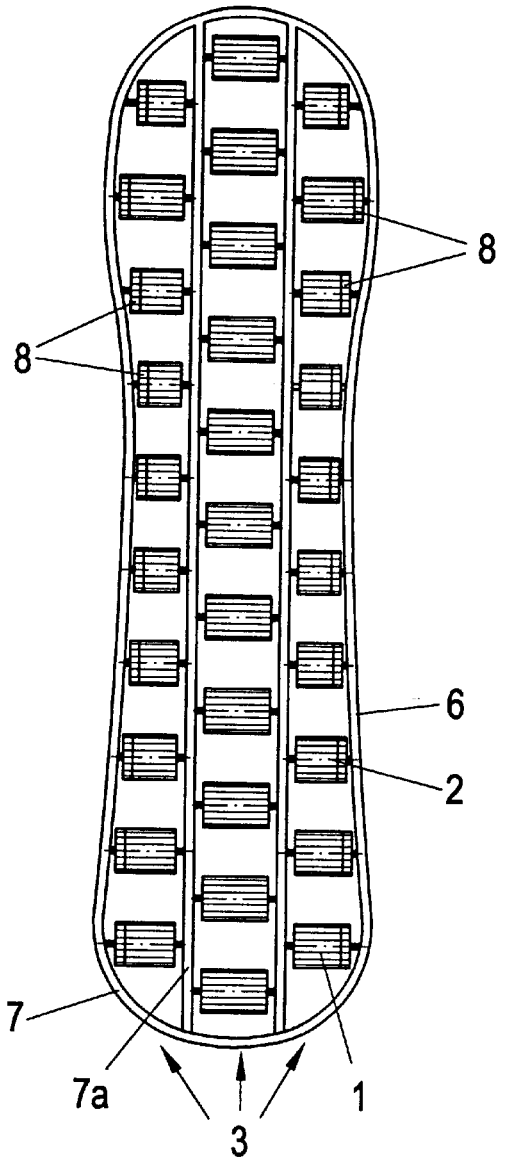
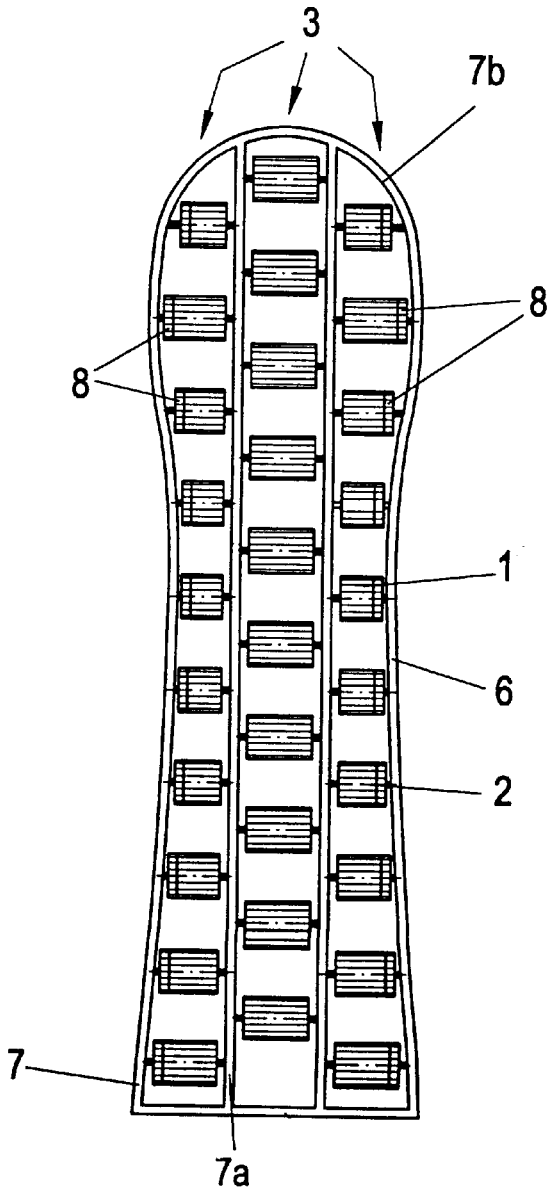
FIG. 2

FIG. 3b
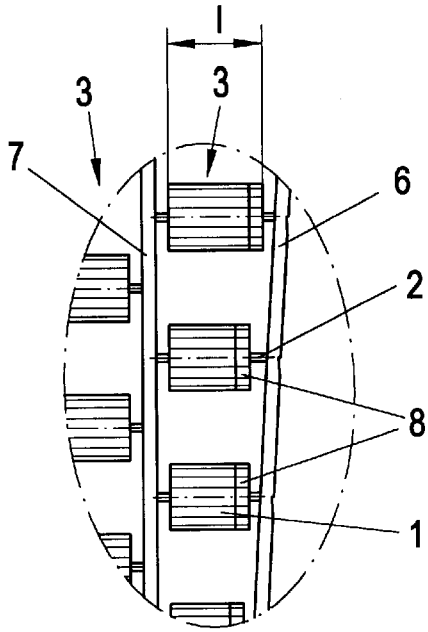
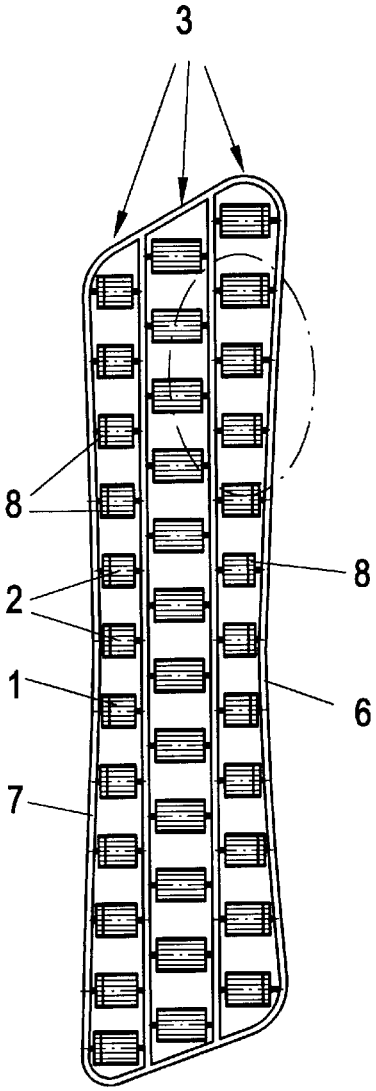
FIG. 3a
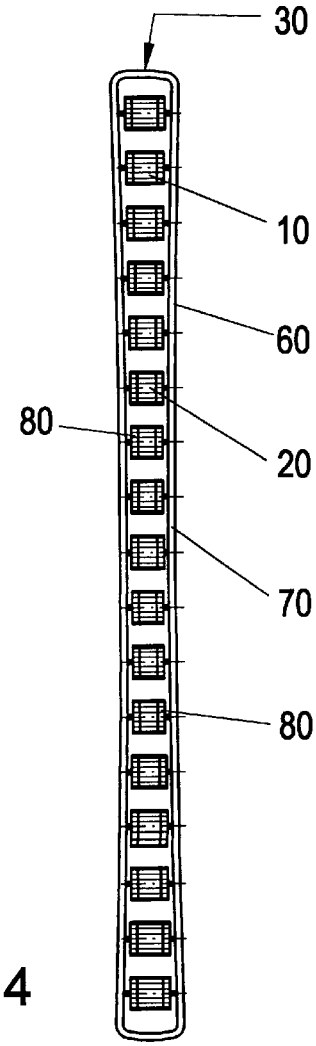
FIG. 4

ROLLER-TYPE SKIING DEVICE FOR NEGOTIATING A SLOPE

BACKGROUND OF THE INVENTION

The present invention refers to a roller-type skiing device of a type having a chassis for supporting wheels on the underside, and in particular to a roller skiboard for two-footed stand and to a roller ski for one-footed stand.

Roller-type skiing devices of this type are useful for work-out or summer training and enable a user to negotiate natural slopes of sand, soil, gravel or the like with or without vegetation, or artificial slopes of concrete, asphalt or like material much like alpine skiers or snowboarders, completely without any snow base and to execute swings to maintain a safe running speed.

A drawback of conventional roller-type skiing devices is the distribution of the wheels on the underside without any consideration to the envelope of the roller ski or the roller skiboard. By disregarding the configuration of the underside and its envelope, the formed running surface of such roller skis or roller skiboards differs from alpine skis or snowboards so that the desired characteristics of alpine skis or snowboards cannot be simulated. The running behavior of the snowboards or skis is dependent on the configuration of the running surface so that various types of skiboards such as freestyle boards, all-round boards, goofie boards or race boards can be identified.

Conventional roller skiboards are unable to simulate the different running behavior of snowboards when used in summer. Also the configuration, such as waisting and curving of simple skis has a great impact upon the swinging or gliding capability during downhill skiing. This different behavior of the skiing device is particularly relevant to skilled skiers, however, conventional roller skis are not designed to meet these requirements.

SUMMARY OF THE INVENTION

It is an object of the present invention to provide an improved roller-type skiing device obviating the aforestated drawbacks.

In particular, it is an object of the present invention to provide an improved roller-type skiing device which simulates the running behavior to resemble respective winter skiing devices.

It is another object of the present invention to provide a roller-type skiing device which enables a particular effective grip of the edges.

It is still another object of the present invention to provide an improved roller-type skiing device which is characterized by a firm mounting of the wheels.

These objects and others which will become apparent hereinafter are attained in accordance with the present invention in connection with a roller skiboard by providing a chassis having several longitudinal rows carrying a plurality of wheels which are preferably spaced from each other at a same distance and rotate about axes of rotation arranged in parallel relationship to each other, with the wheels of one row being arranged offset to the wheels of neighboring rows, and with the wheels being evenly spaced over the entire underside which is bound by an envelope, whereby the wheels of the row of the wheels neighboring the envelope have varying length to conform to the contour of the envelope, and whereby the free intermediate area between neighboring wheels is not significantly greater than an area covered by the wheels.

By evenly distributing the wheels, the configuration common in winter sport devices can be applied to roller skiboards for simulating their running behavior in summer. The dense arrangement of the wheels forms a substantially similar running surface, with the running surface in particular following the curved envelope. A further advantage of the present invention is the offset arrangement of the rows of wheels as it renders the wheels accessible and thus allows a very rapid attachment of the wheels.

In accordance with the present invention, roller-type skiing devices in form of roller skis for single-footed stand are characterized by a single longitudinal row carrying a plurality of wheels which are preferably spaced from each other at essentially a same distance and rotate about axes of rotation arranged at parallel relationship to each other, with the wheels being evenly spread over the entire underside which is bounded by an envelope whereby the length of the wheels varies to conform to the contour of the envelope and whereby the free intermediate space between neighboring rollers is not significantly greater than the area covered by the wheels.

Thus, the waisting or curving of the ends as common in alpine skis can be applied to roller skis so that the running behavior of alpine skis can be simulated with roller skis according to the present invention.

Preferably, the underside is part of the chassis which is configured to follow at least partially the envelope of the underside. In this manner, the wheels can easily and precisely arranged by adjusting the length of the wheels to conform to the contour of the envelope.

In accordance with a further feature of the present invention, the wheels have an end face which neighbors the envelope of the underside and is provided with a disk-shaped or ring-shaped terminal piece of an edge hard material, e.g. steel or diamond, to enable roller skis according to the present invention to simulate the function of edges of alpine skis. Suitably, the terminal piece of the wheels are flush-mounted with the outer surface area of the wheels so that a spinning of the wheels will not be obstructed when skiing down in a straight line.

According to another feature of the present invention, the terminal piece of each wheel may project beyond the diameter of the wheels, with the projecting part bounding a hollow cylinder which is placed over the wheel and made of elastic material, e.g. hard rubber. Thus, when initiating a swing, the edges of the terminal piece of the wheels become exposed as the elastic material of the hollow cylinder is compressed under pressure.

According to a further feature of the present invention, at least the underside is upwardly curved on one or both axial ends. In view of the even distribution of the wheels over the entire underside, also the curved part of the roller-type skiing device is provided with wheels so that the function of the curvature in common alpine skis is also simulated by the roller-type skiing devices, for example to support the execution of a figure jump.

Preferably, in roller-type skiing devices in form of roller skiboards, the middle row of wheels has wheels of greater diameter than the diameter of the wheels of neighboring rows. By increasing the diameter of the wheels in the middle row, the user is able to tilt the roller skiboard when shifting the own weight so as to facilitate initiation of a swing or facilitate a breaking action.

In order to achieve a highly cost-efficient manufacture of a roller-type skiing device according to the present invention, the chassis is preferably formed at least partially by side walls of the roller-type skiing device.

Advantageously, the axis of rotation of each wheel is formed by an axle having one end adapted for attachment of a socket-head screw and another end provided with a blind bore, with the axle traversing longitudinally a bore through the wheel. In prolongation of each axial end of the bore is a counterbore for receiving a ball-and-socket joint by which the axle is supported and secured to the chassis via a socket head screw. Thus, the wheels are supported in a very stable manner so that ground material of the slope will not adversely affect the spinning or rolling properties of the wheels.

BRIEF DESCRIPTION OF THE DRAWING

The above and other objects, features and advantages of the present invention will now be described in more detail with reference to the accompanying drawing in which:

FIG. 1 is a schematic plan view of an underside of a first embodiment of a roller skiboard according to the present invention;

FIG. 2 is a schematic plan view of an underside of a second embodiment of a roller skiboard according to the present invention;

FIG. 3*a* is a schematic plan view of an underside of a third embodiment of a roller skiboard according to the present invention;

FIG. 3*b* is a fragmentary illustration of the roller skiboard according to FIG. 3*a;*

FIG. 4 is a schematic plan view of an underside of a first embodiment of a roller ski according to the present invention;

DETAILED DESCRIPTION OF PREFERRED EMBODIMENTS

Figure 5A:
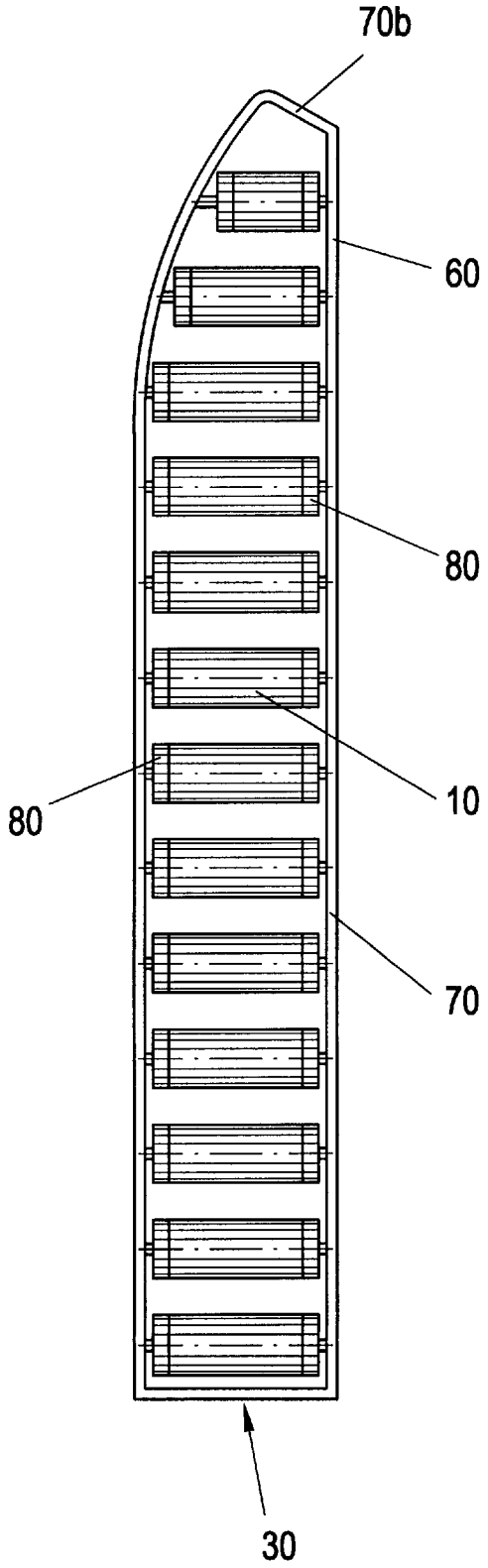
FIGS. 5*a*, 5*b* and 6 are schematic plan views of an underside of further embodiments of a roller ski according to the present invention.

Turning now to the drawing, and in particular to FIG. 1, there is shown a schematic plan view of the underside of a first embodiment of a roller-type skiing device in form of a freestyle roller skiboard for two-footed stand. The roller skiboard has a chassis 7 which supports longitudinally several rows 3 with a plurality of wheels 1 which are spaced from each other preferably at a same distance and form a running surface for the roller skiboard. The wheels 1 are rotatably mounted on axles 2 which extend in parallel relationship to each other.

Although not shown in detail, the roller skiboard can be equipped with same safety bindings as used in conventional snowboards. The safety bindings are mounted to the roller skiboard at an equivalent location and in a same manner as snowboards in order to create a same running behavior. For simulating a freestyle snowboard, the wheels 1 are evenly distributed over the entire underside which is bounded by a curved envelope 6. In order to ensure such an even distribution across the entire underside, the length of those wheels 1 which adjoin the envelope 6 varies to conform to the contour of the envelope 6, whereby the free space between neighboring rollers 1 is essentially not greater than the area covered by the wheels 1. In the non-limiting example of FIG. 1, the rows 3 of wheels 1 are offset to each other by half a wheel distance. It will be readily understood that the rows of wheels may be staggered to each other also by any other suitable distance.

The axles 2 of the wheels 1 are mounted in the chassis 7 which is guided along the curved envelope 6 of the underside and includes parallel support bars 7*a* within the envelope 6 for separating the rows 3 and supporting the wheels 1. By curving the exterior of the chassis 7 to conform to the envelope 6, the length of the wheels 1 received in the outermost rows 3 is varied to follow exactly the outline of the envelope 6 of the roller skiboard so that the distribution of the wheels 1 simulate a running surface which resembles the running surface of snowboards.

As further shown in FIG. 1, the wheels 1 arranged in the outermost rows 3 have one axial end in proximity to the envelope 6 of the underside, which is provided with an annular terminal piece 8 made of steel to simulate an edge to support a swing or a change in the direction. The terminal piece 8 may also be of disk-shaped configuration and may be made of any suitable edge material, such as diamond. The use of the terminal pieces 8 to form edges is in particular suitable for natural slopes of sand, rubble, soil or the like. On artificial surfaces such as concrete, asphalt or the like, the provision of such edges may be omitted.

FIG. 2 shows a schematic plan view of the underside of a second embodiment of a roller-type skiing device in form of an all-round roller skiboard which differs from the freestyle roller skiboard of FIG. 1 in the configuration of the tail 7*c* which is not curved but cut off at a right angle. The wheels 1 of this type of roller skiboard are also evenly distributed across the underside, with the length of the wheels 1 of the outermost rows next to the envelope 6 varying to conform to the contour of the curved envelope 6. In this manner, all areas of the underside including the tip 7*c* of the skiboard can be evenly covered with wheels 1 to simulate the running behavior of a snowboard.

FIG. 3*a* is a schematic plan view of an underside of a third embodiment of a roller-type skiing device in form of a race roller skiboard which differs from the previous roller skiboards only in the configuration of the tip 7*b* and tail 7*c* which are slantingly configured. FIG. 3*b* clearly shows the variation of the length l of the wheels 1 to conform to the configuration of the envelope 6. The end faces of the wheels 1 in proximity of the envelope 6 are provided with the terminal pieces i.e. steel rings 8 which are flush-mounted to the end face of the wheels 1.

In all embodiments of roller skiboards according to the invention, the middle row 3 of wheels 1 has wheels 1 of greater diameter than the wheels 1 of neighboring rows 3. The greater diameter of the wheels 1 in the middle row 3 allows a tilting of the skiboard when the skier shifts the weight to one or the other side to facilitate a swing.

FIG. 4 is a schematic plan view of an underside of a roller-type skiing device in form of a roller ski for attachment to one leg, with the ski underside having one longitudinal row 30 with a plurality of wheels 10 which are preferably spaced from each other at a same distance. The wheels 10 are rotatable mounted on axles 20 extending in parallel relationship to each other and are evenly distributed over the entire underside which is bounded by a curved envelope 60, with the length of the wheels 10 conforming to the contour of the envelope 60 and with the free intermediate space between neighboring wheels 10 being essentially not greater than the area covered by the wheels 10. Thus, the configuration of winter skis which commonly have a waisted area, i.e. a greater width at its axial ends than in the middle part, and upwardly curved ends is applicable to the roller skis according to the invention which therefore simulate a same running behavior as the winter skis.

The chassis 70 for supporting the axles 20 also conforms precisely to the contour of the envelope 60. Since the roller ski includes only one row 30 of wheels 10, each wheels 10 is provided at their axial ends with a flush-mounted steel ring 80 to ensure a required grip along both longitudinal edges of the roller ski.

By adjusting the configuration of the envelope 60, the roller skis according to the invention can be selectively used for slalom, giant slalom, downhill, cross country or the like or for ski jumping.

Figure 5B:
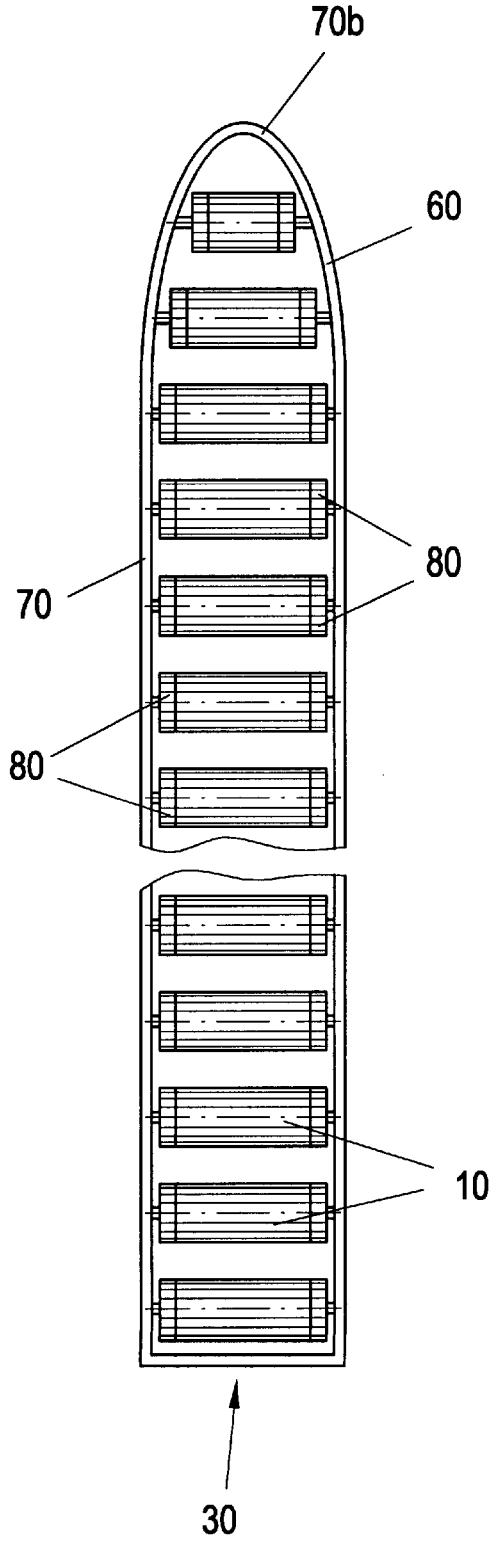

FIG. 5*a* shows a schematic plan view of the underside of a roller ski which is formed with an asymmetrical tip 70*b*. This roller ski is for attachment to the left foot of a skier. The shape of the right ski is a mirror image along the longitudinal axis. As shown in FIG. 5*a*, the length of the wheels 10 narrows in direction towards the tip 70*b* of the roller ski to conform to the contour of the envelope 60 which corresponds to the contour of the chassis 70. FIG. 5*b* shows a roller ski with symmetrically tapered tip 70*b*, with the length of the wheels 10 narrowing towards the tip 70*b*.

Figure 6:
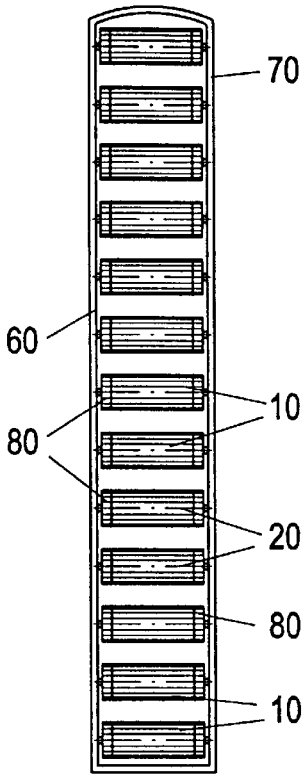
Figure 8:
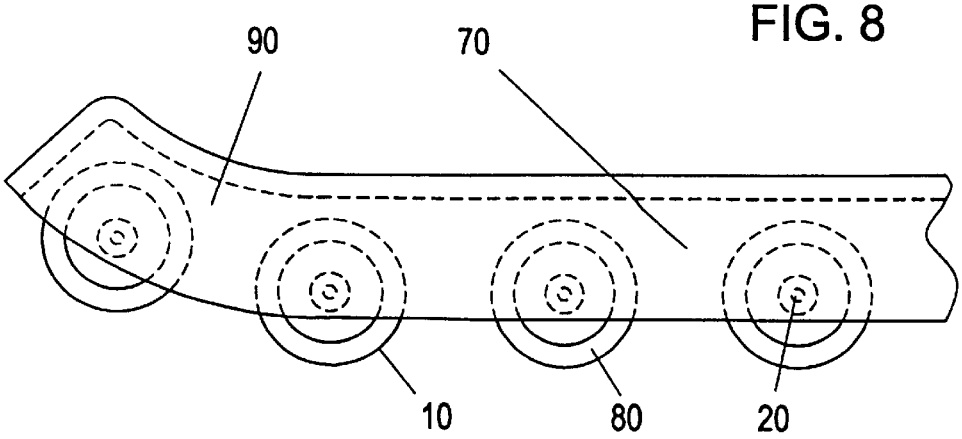
FIG. 8 is a schematic side view of the roller ski of FIG. 6.

FIG. 6 shows a further embodiment of a roller ski with evenly distributed wheels 10 across the underside. The envelope 60 is rectilinear so that the wheels 10 are of same length. Both axial ends of each wheel 10 are provided with a terminal piece in form of a steel ring 80. From FIG. 8, which is a schematic side view of the roller ski of FIG. 6, it can be seen that part of the chassis 70 is formed by side walls 90 (only one side wall 90 is shown in the illustration of FIG. 8) which support the axles 20 of the wheels 10. The side walls 90 are upwardly curved on one or also on both longitudinal ends of the ski, with wheels 10 being provided also in the upwardly curved areas in order to simulate the function of upwardly curved ends of winter skis, e.g. during jumping. The wheels 10 only partially project beyond the side walls 90 downwards and thus are partially set back relative to the chassis 70.

Figure 7:
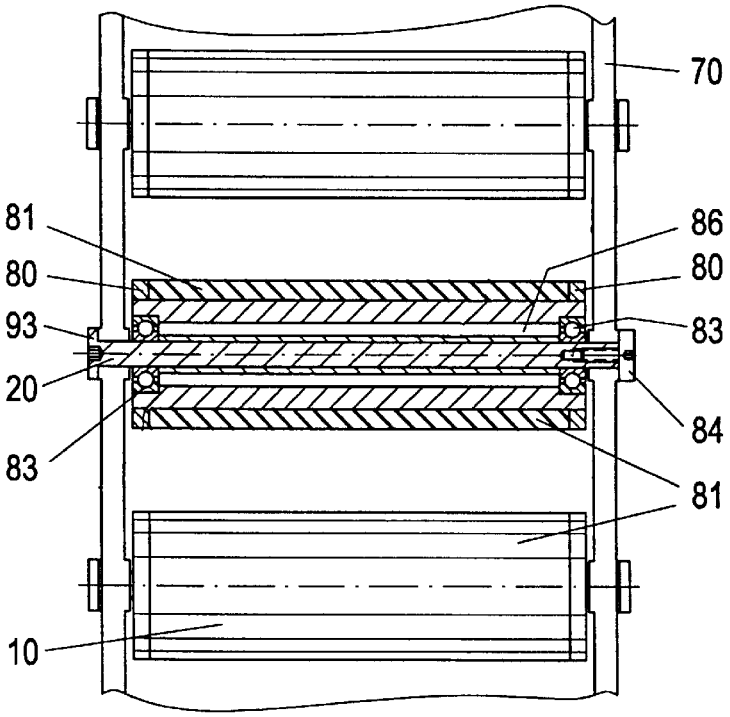
FIG. 7 is a fragmentary, partially sectional view of a roller ski according to the invention, illustrating in detail the support of a wheel.

FIG. 7 shows a fragmentary, partially sectional view of a roller-type skiing device in form of a roller ski according to the invention, illustrating in detail the support of the wheels 10. The ring-shaped terminal pieces 80 project laterally beyond the core diameter of the wheels 10 on both axial ends thereof and are flush-mounted to a hollow cylinder 81 which is made of elastic material, e.g. hard rubber and placed over the wheel 10. When negotiating a slope, an edging of the skis causes a compression of the hollow cylinder 81 of elastic material to expose the steel rings 80 which thus provide a firm grip much like the edges of alpine skis.

Each wheel 10 has a central bore 86 which is extended on both axial ends by a counterbore 87 for receiving a ball and socket joint 83 which supports the axle 20. The axle 20 traverses the wheel 10 over its entire length and projects at one end through an opening in the side wall of the chassis 70 for allowing a head 93 of the axle to rest on the chassis. The other end of the axle 20 is provided with a blind bore 91 (see FIG. 13) for engagement by a socket-head screw 84 from outside, with the head of the screw 84 resting upon the side wall of the chassis 70. In this manner, the axle 20 is securely attached to the chassis 70.

Figure 13:
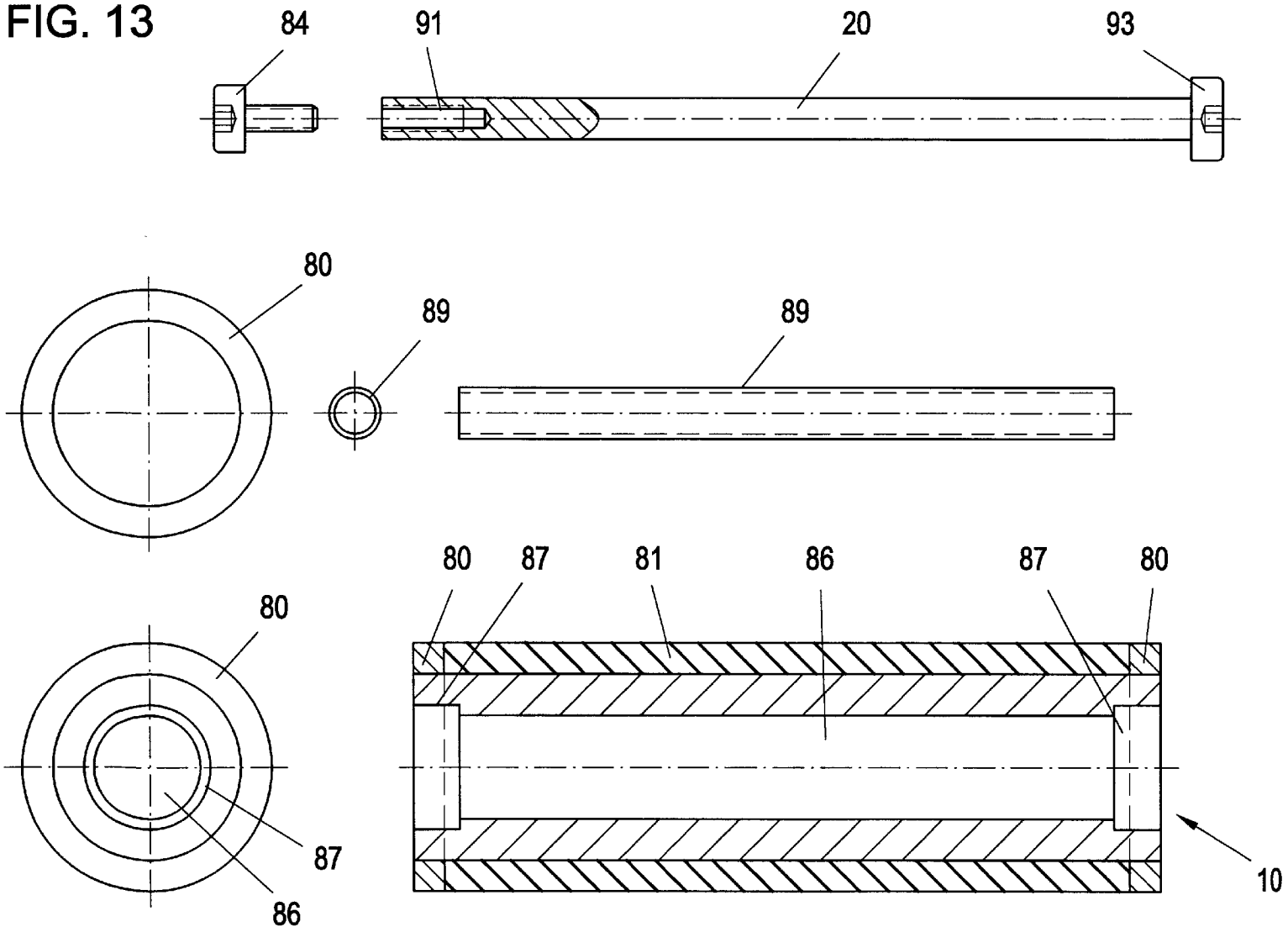
FIG. 13 is a schematic illustration of individual parts of a wheel for use in a roller skiboard according to the present invention.

In FIG. 13, the individual parts of the wheel 10 for use in a roller ski are again shown in exploded illustration. As shown in FIG. 13, the wheel 10 is provided with the axial bore 86 ending on both ends in a counterbore 87. Received in each counterbore 87 is the ball-and-socket joint 83 (not shown in FIG. 13) and secured via a tubular part 89 in the bore 86. The axle 20 is routed through both ball-and-socket joints 83 and is received in two opposing openings of the chassis 70, with the socket-head screw 84 engaging the blind hole 91 which is formed in one end of the axle 20.

Figure 9:
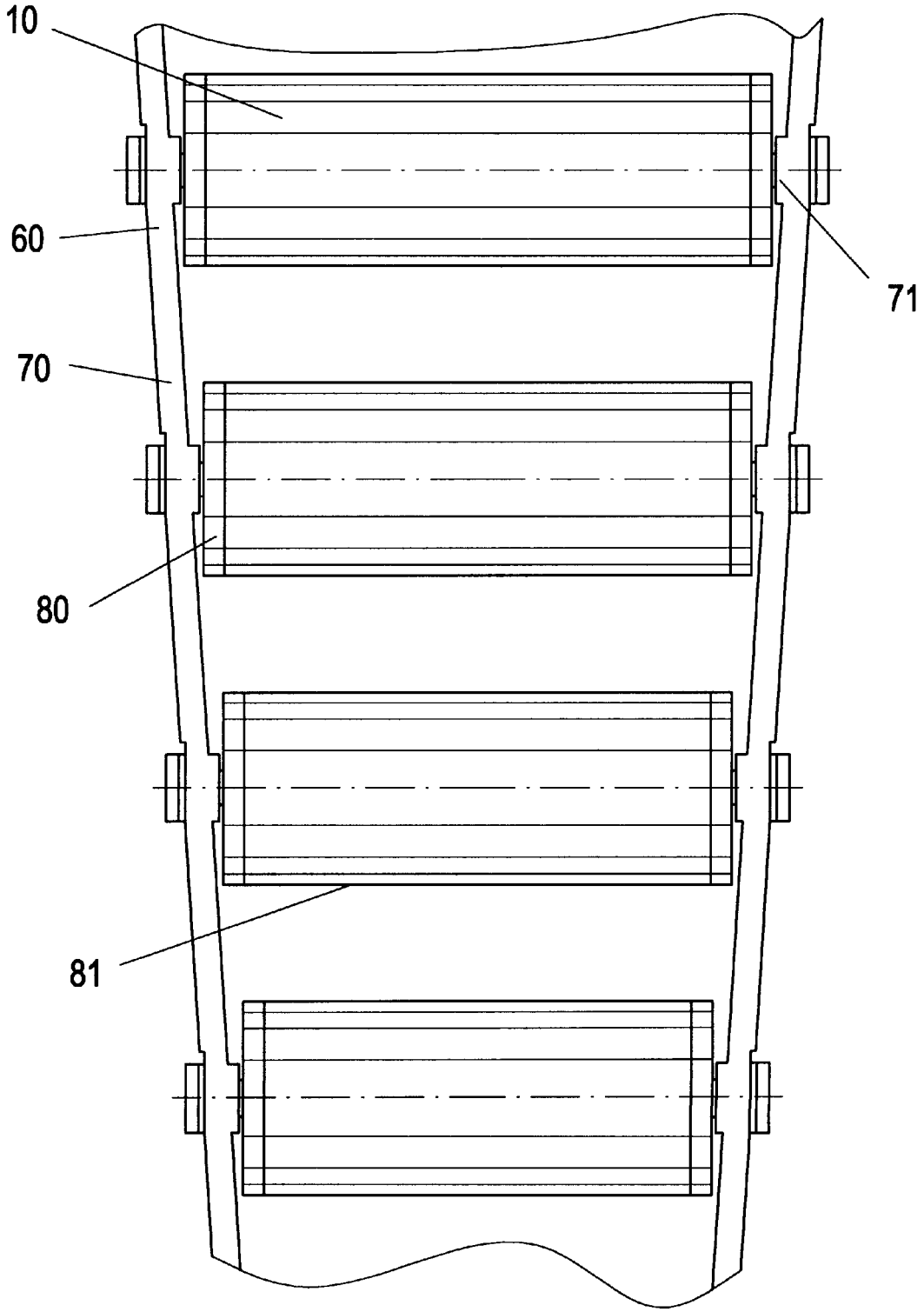
FIG. 9 is a fragmentary illustration of an underside of a waisted roller ski.

FIG. 9 shows a section of a roller ski with wasting to show the variation of the wheel length to conform to the contour of the envelope 60. Each wheel 10 includes on each axial end the lateral ring-shaped terminal piece 80 of steel which is flush-mounted to the hollow cylinder 81 of hard rubber surrounding the wheel 10. When shifting the weight during negotiating a slope, the hard rubber lining 81 is respectively compressed on the loaded side so as to expose the steel ring 80 and thus to provide the roller ski with a firm edge grip in a very effective manner as the exposed part of the steel ring 80 penetrates the ground.

The chassis 70 is suitably provided with stubs 71 for supporting the axles 20 and thus to securely mount the axle ends. In all embodiments, the axles are stationary while the respective wheels rotate about these axles. Persons skilled in the art will understand that it is certainly possible to connect the axles with the wheels and to allow the axles to rotate in bearing journals of the chassis.

Figure 10:
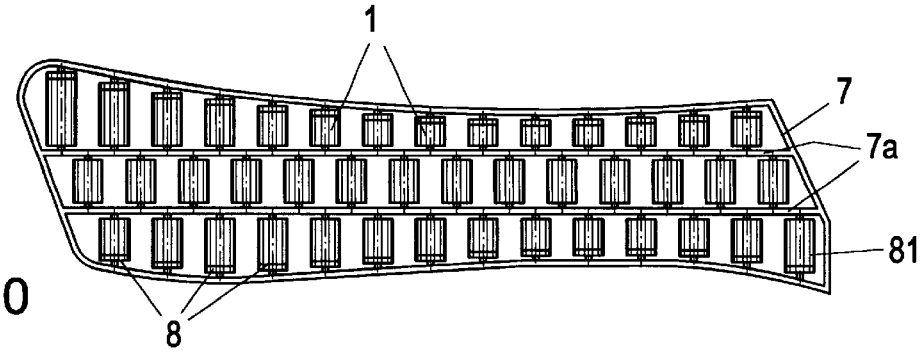
FIG. 10 is a schematic plan view of an underside of a fourth embodiment of a roller skiboard according to the present invention.

FIG. 10 shows a further embodiment of a roller-type skiing device in form of a race roller skiboard with curved ends. As can be seen in FIG. 10, only the wheels 1 in the outermost rows 3 are provided with disk-shaped or ring-shaped terminal pieces 8 at their end faces proximate to the envelope 6. The chassis 7 is configured to conform to the contour of the envelope 6 and includes two parallel support bars 7*a* for support of the axles 2 of the wheels 1.

Figure 11:
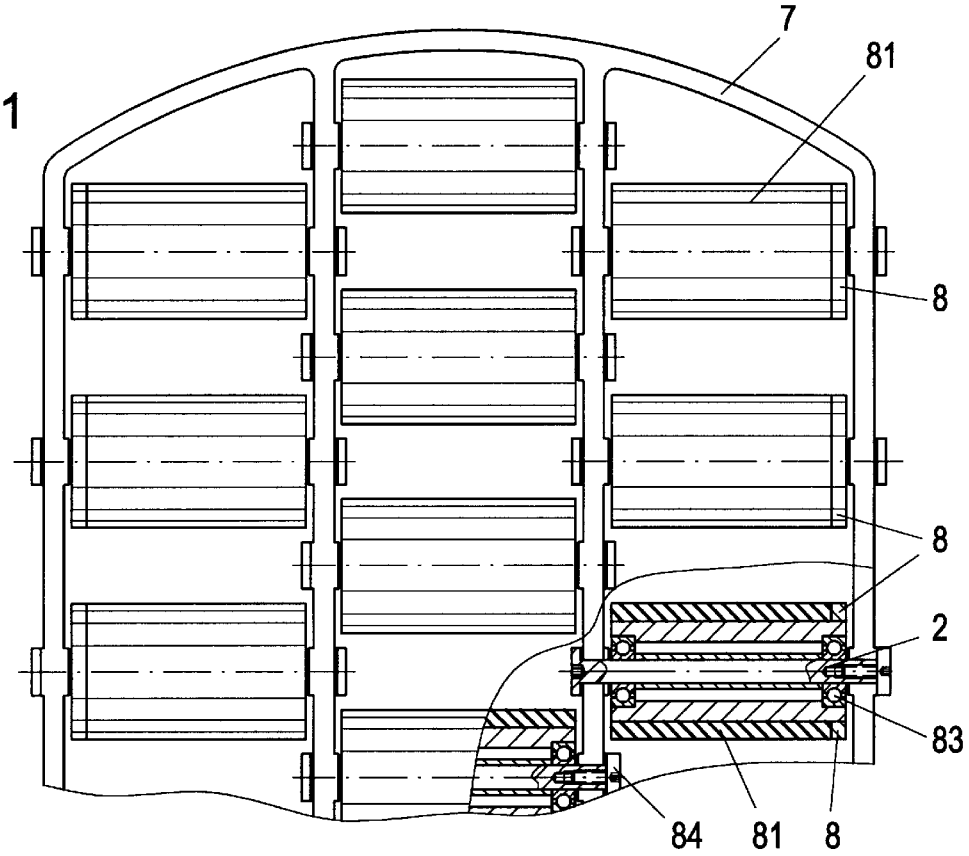
FIG. 11 is a fragmentary, partially cross sectional view of a roller skiboard according to the present invention, illustrating in detail the support of a wheel.

FIG. 11 shows a detailed illustration of the support of the wheels 1 in the chassis 7 which essentially resembles the support of the wheels shown in FIG. 7. Each axle 2 traverses the wheel 1 and is supported on each axial end by a ball-and-joint socket 83 and secured to the chassis 7 by a socket-head screw 84. The offset arrangement of the wheels 1 between neighboring rows 3 allows easy access to and easy attachment of the axles 2 via the socket-head screws 84. Also in the non-limiting example of FIG. 11, only the end faces of the wheels 1 adjacent the envelope 6 are provided with the ring-shaped terminal piece 8 which is flush-mounted to the hollow hard rubber cylinder 81.

Figure 14:
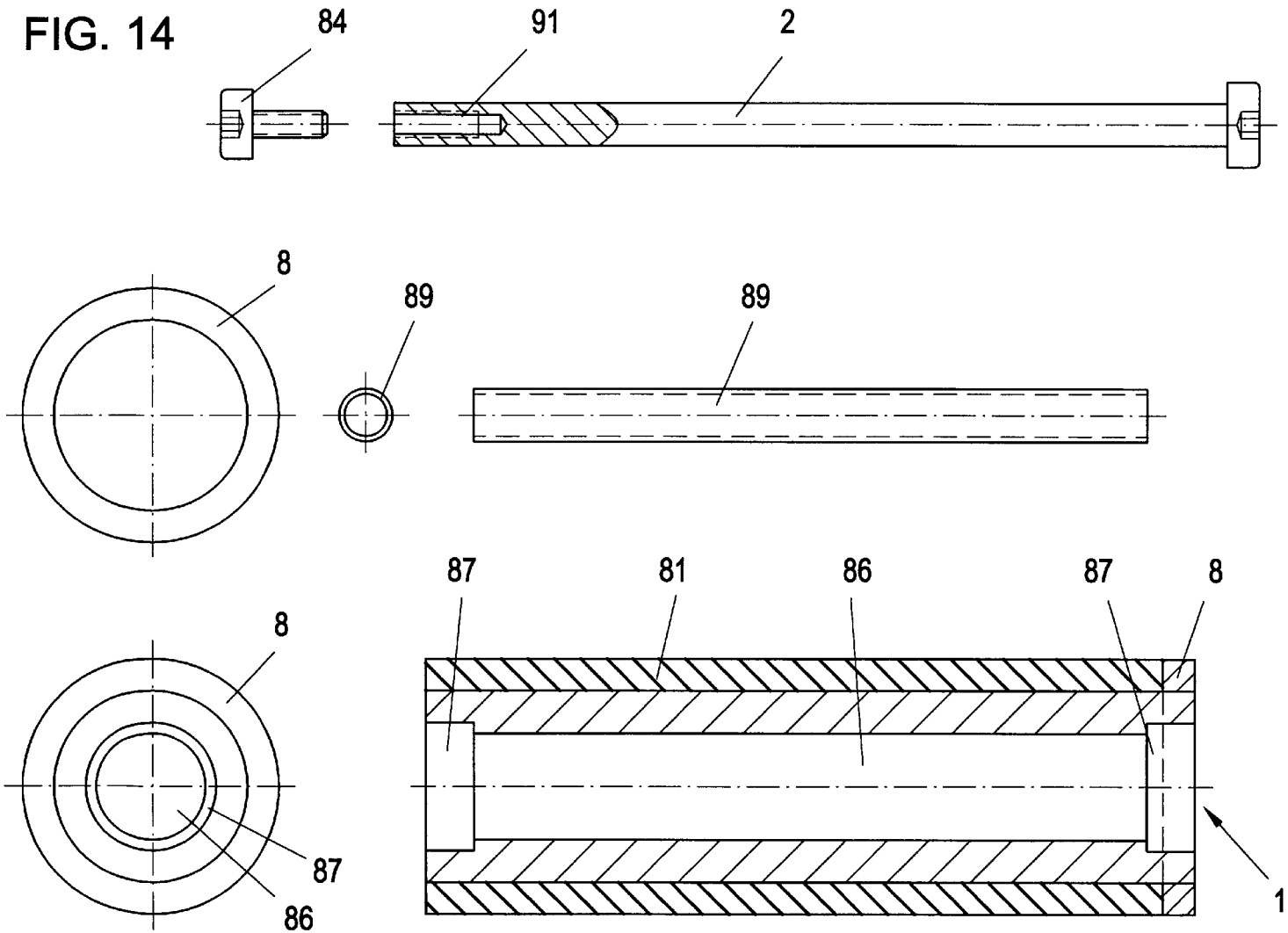
FIG. 14 is a schematic illustration of individual parts of a wheel for use in a roller ski according to the invention.

In FIG. 14, the individual parts of the wheel 1 for use in a roller skiboard according to the invention are again shown by way of an exploded view, with only the wheels 1 of the outermost rows being provided on one end face with steel rings 8 which are flush-mounted to the hollow cylinders 81. The wheels 1 in the middle row for the roller skiboard need not be provided with any steel rings and are completely surrounded by a continuous hollow cylinder 81. However, the wheels 1 in the middle row may have a greater diameter, e.g. by few millimeters, as the wheel of the neighboring rows to effect the described tilting action.

Figure 12:
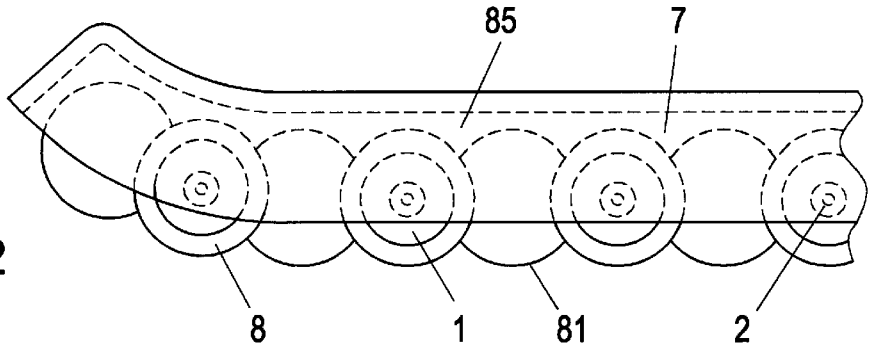
FIG. 12 is a side view of the roller skiboard according to FIG. 11.

FIG. 12 is a side view of the roller ski board of FIG. 11 and it can be seen that part of the chassis 7 is formed by side walls 85 (only one side wall 85 is shown in the illustration of FIG. 12) which support the axles 2 of the wheels 1. The side walls 85 may be upwardly curved on one end or on both ends of the skiboard, with wheels 1 being evenly provided also in the upwardly curved areas in order to simulate the function of upwardly curved ends of a snowboard. The wheels 1 only partially project beyond the side walls 85 downwards and thus are partially set back relative to the chassis 7.

While the invention has been illustrated and described as embodied in a roller-type skiing device for negotiating a slope, it is not intended to be limited to the details shown since various modifications and structural changes may be made without departing in any way from the spirit of the present invention.

What is claimed as new and desired to be protected by Letters Patent is set forth in the appended claims:

1. A roller-type skiing device, comprising:

a chassis defining a longitudinal axis and having an underside bounded by an envelope;

at least one longitudinal row of a plurality of wheels supported by said chassis and evenly spaced over said entire underside, said wheels having one end face which neighbors said envelope of said underside and being rotatably mounted about rotational axes which are arranged in parallel relationship and being of varying length to conform to the contour of said envelope, with neighboring wheels defining a free intermediate space which is at most equal to an area covered by said wheels;

a terminal piece provided on said end face of each said wheel and made of a hard material to form an edge, said wheel exhibiting a diameter, with said terminal piece projecting beyond said diameter; and a hollow cylinder placed over said wheel in flush-mounted disposition to said terminal piece, said hollow cylinder being made of elastic material so that during negotiation of a turn the edge of said terminal piece is exposeable to effect a firm grip.

2. The roller-type skiing device of claim 1 wherein several rows of a plurality of wheels are supported by said chassis, with each row carrying a plurality of wheels, said wheels of one row being arranged offset to said wheels of a neighboring row of wheels, wherein said rows of wheels neighboring said envelope have wheels of varying length to conform to the contour of said envelope.

3. The roller-type skiing device of claim 2 wherein a middle row of wheels has wheels of a greater diameter than a diameter of said wheels of neighboring rows.

4. The roller-type skiing device of claim 1 wherein said wheels are essentially evenly spaced from each other.

5. The roller-type skiing device of claim 1 wherein said envelope is of curved configuration.

6. The roller-type skiing device of claim 1 wherein said chassis is guided at least partially along said envelope.

7. The roller-type skiing device of claim 1 wherein said terminal piece is made of steel.

8. The roller-type skiing device of claim 1 wherein said hollow cylinder is made of hard rubber.

9. The roller-type skiing device of claim 1 wherein said underside has at least one axial end which is upwardly curved.

10. The roller-type skiing device of claim 1 wherein said chassis is partially formed by side walls of the roller-type skiing device.

11. The roller-type skiing device of claim 1 wherein each said wheel has a bore traversing longitudinally said wheel and extended on each end with a counterbore for receiving a ball-and-socket joint, said rotational axis of each of said wheels being formed by an axle extending through said bore and having one end adapted for attachment of a socket-head screw and another end provided with a blind bore, said axle being supported in said ball-and-socket joint and connected to said chassis via a socket-head screw engaging said blind bore.

12. The roller-type skiing device of claim 1 wherein said terminal piece is of disk-shaped configuration.

13. The roller-type skiing device of claim 1 wherein said terminal piece is of ring-shaped configuration.

14. A roller skiboard for two-footed stand, comprising:

a chassis defining a longitudinal axis and having an underside bounded by an envelope; and a plurality of longitudinal rows carrying a plurality of wheels supported by said chassis and evenly distributed across said entire underside, said wheels having one end face which neighbors said envelope of said underside and being rotatably mounted about rotational axes which are arranged in parallel relationship to each other, with said wheels of one row being arranged offset to said wheels of a neighboring row of wheels, said row of wheels neighboring said envelope having varying length to conform to the contour of said envelope, with neighboring wheels defining a free intermediate space which is at most equal to an area covered by said wheels;

a terminal piece provided on said end face of each said wheel and made of a hard material to form an edge, said wheel exhibiting a diameter, with said terminal piece projecting beyond said diameter; and a hollow cylinder placed over said wheel in flush-mounted disposition to said terminal piece, said hollow cylinder being made of elastic material so that during negotiation of a turn the edge of said terminal piece is exposeable to effect a firm grip.

15. A roller ski for one-footed stand, comprising:

a chassis defining a longitudinal axis and having an underside bounded by an envelope;

a plurality of wheels supported by said chassis and arranged in one longitudinal row, said wheels being evenly distributed over said entire underside and rotatably mounted on axles which are arranged in parallel relationship to each other, said wheels having opposite end faces and configured of varying length to conform to the contour of said envelope, with neighboring wheels defining a free intermediate space which is not significantly greater than an area covered by said wheels;

a terminal piece provided on each said end face of each said wheel and made of a hard material to form an edge, said wheel exhibiting a diameter, with said terminal piece projecting beyond said diameter; and a hollow cylinder placed over said wheel in flush-mounted disposition to said terminal piece, said hollow cylinder being made of elastic material so that during negotiation of a turn the edge of said terminal piece is exposeable to effect a firm grip.

* * * * *